US011357316B2

(12) United States Patent
King

(10) Patent No.: US 11,357,316 B2
(45) Date of Patent: Jun. 14, 2022

(54) BALE CARRYING DEVICE

(71) Applicant: Walter E. King, Senoia, GA (US)

(72) Inventor: Walter E. King, Senoia, GA (US)

( * ) Notice: Subject to any disclaimer, the term of this patent is extended or adjusted under 35 U.S.C. 154(b) by 0 days.

(21) Appl. No.: 16/704,035

(22) Filed: Dec. 5, 2019

(65) Prior Publication Data

US 2021/0061532 A1 Mar. 4, 2021

Related U.S. Application Data

(60) Provisional application No. 62/892,928, filed on Aug. 28, 2019.

(51) Int. Cl.
*A45F 5/10* (2006.01)
*B65D 63/18* (2006.01)

(52) U.S. Cl.
CPC ..... *A45F 5/102* (2013.01); *A45F 5/1026* (2013.01); *B65D 63/18* (2013.01); *A45F 2005/1053* (2013.01)

(58) Field of Classification Search
CPC ..... A45F 5/102; A45F 2005/1053; A45F 5/1026; A45F 2005/1033; B65D 63/18
USPC ..... D9/455; 294/159
See application file for complete search history.

(56) References Cited

U.S. PATENT DOCUMENTS 424,806 A * 4/1890 Morris ..... A45F 5/10 294/154
2,749,172 A * 6/1956 Jacobs ..... A45F 5/1026 294/26
D184,420 S 2/1959 Carlisle
D219,278 S 11/1970 Protzmann et al.
4,004,722 A * 1/1977 Olivier ..... A45F 5/1026 294/171
D269,253 S * 6/1983 Gagnon ..... 294/137
4,420,178 A * 12/1983 Taylor ..... A45F 5/1026 229/117.19
4,741,492 A * 5/1988 Reysen ..... A45F 5/10 242/129
4,919,466 A * 4/1990 Consler ..... A45F 5/1026 16/406

(Continued)

FOREIGN PATENT DOCUMENTS

CN 200941890 9/2007
CN 202365136 8/2012

(Continued)

OTHER PUBLICATIONS

"Hay Handles" Make Bales Easy To Carry, 2015, Farm Show Magazine, Volume #39, Issue #3, Page #19, https://www.farmshow.com/a_article.php?aid=29268 (Year: 2015).*

(Continued)

*Primary Examiner* — Jeffrey O'Brien
(74) *Attorney, Agent, or Firm* — Taylor English Duma LLP

(57) ABSTRACT

A bale carrying device includes a main body defining a handle portion; and a binding catch extending from the main body, the binding catch configured to engage a binding of a bale. A method for using a bale carrying device includes grasping a handle portion of a main body of the bale carrying device; engaging a binding catch of the bale carrying device with a binding of a bale, the binding catch extending from the main body, the binding extending around the bale; and lifting the bale with the bale carrying device.

7 Claims, 16 Drawing Sheets

(56) References Cited

U.S. PATENT DOCUMENTS

| | | | | |
|---|---|---|---|---|
| 5,487,581 | A * | 1/1996 | Carmo | A45F 5/1026 294/137 |
| 5,507,544 | A * | 4/1996 | McQuade | A45F 5/10 220/759 |
| 5,527,076 | A | 6/1996 | Randels | |
| 5,665,409 | A * | 9/1997 | Drewry | B65D 63/18 294/149 |
| 5,667,266 | A * | 9/1997 | Giocanti | A45F 5/1026 294/159 |
| 5,707,096 | A | 1/1998 | Gregory | |
| D400,785 | S * | 11/1998 | Randall | D9/434 |
| 5,992,803 | A * | 11/1999 | LeRoux | A45F 5/1026 248/100 |
| D441,653 | S * | 5/2001 | LeRoux | D9/434 |
| D447,952 | S | 9/2001 | Valkovich | |
| 6,334,531 | B1 * | 1/2002 | Valkovich | B65D 71/50 206/163 |
| 6,382,549 | B1 * | 5/2002 | Krake | A45F 5/102 242/405.2 |
| D460,677 | S | 7/2002 | Proot et al. | |
| 6,499,781 | B1 * | 12/2002 | Flynn | A45F 3/10 294/159 |
| D474,389 | S | 5/2003 | Panfili et al. | |
| 6,623,056 | B1 * | 9/2003 | Wickson | A45F 5/102 294/137 |
| D511,083 | S | 11/2005 | Gurzenda et al. | |
| 7,097,223 | B1 | 8/2006 | Bradford | |
| D542,213 | S | 5/2007 | Rodriguez | |
| D615,876 | S | 5/2010 | Oster | |
| 7,874,602 | B2 * | 1/2011 | Meckwood | A45F 5/102 294/137 |
| D657,241 | S | 4/2012 | Nidetz | |
| 8,708,384 | B2 | 4/2014 | Boland | |
| D735,013 | S | 7/2015 | White | |
| D793,233 | S * | 8/2017 | Fuhry | D9/455 |
| 9,743,746 | B2 * | 8/2017 | Martinez | A45F 5/102 |
| D846,967 | S | 4/2019 | Werdowatz | |
| D853,820 | S | 7/2019 | Garrido | |
| 10,772,415 | B1 * | 9/2020 | Swenson | B65G 7/12 |
| D933,448 | S | 10/2021 | Spadavecchia | |
| 11,147,361 | B2 | 10/2021 | Krivokapic et al. | |
| D934,650 | S | 11/2021 | King | |
| 2002/0101087 | A1 | 8/2002 | Thielking et al. | |
| 2004/0212208 | A1 * | 10/2004 | Link | A45F 5/1026 294/159 |
| 2005/0044662 | A1 * | 3/2005 | Yu | A45F 5/1046 16/110.1 |
| 2005/0045676 | A1 | 3/2005 | Bass et al. | |
| 2007/0132254 | A1 * | 6/2007 | Choi | A45F 5/102 294/15 |
| 2008/0169663 | A1 * | 7/2008 | Stelzer | A45F 5/1026 294/170 |
| 2009/0206621 | A1 * | 8/2009 | Payne | A45F 5/1026 294/158 |
| 2014/0265397 | A1 | 9/2014 | Shepherd et al. | |
| 2015/0035306 | A1 | 2/2015 | Ewing | |
| 2017/0055688 | A1 | 3/2017 | Lewis | |

FOREIGN PATENT DOCUMENTS

| | | |
|---|---|---|
| CN | 202386062 | 8/2012 |
| CN | 104665222 | 6/2015 |
| CN | 106880159 | 6/2017 |
| CN | 206714390 | 12/2017 |
| CN | 108851486 | 11/2018 |
| CN | 108937088 | 12/2018 |

OTHER PUBLICATIONS

King, Walter E.; Corrected Notice of Allowance for Design U.S. Appl. No. 29/722,136, filed Jan. 27, 2020, dated Jul. 22, 2021, 8 pgs.
King, Walter E.; Corrected Notice of Allowance for Design U.S. Appl. No. 29/722,136, filed Jan. 27, 2020, dated Jul. 14, 2021, 6 pgs.
King, Walter E.; Notice of Allowance for Design U.S. Appl. No. 29/722,136, filed Jan. 27, 2020, dated Jun. 28, 2021, 18 pgs.
King, Walter E.; Corrected Notice of Allowance for Design U.S. Appl. No. 29/722,136, filed Jan. 27, 2020, dated Oct. 5, 2021, 6 pgs.
King, Walter E.; Non-Final Office Action for Design U.S. Appl. No. 29/809,520, filed Sep. 28, 2021, dated Feb. 28, 2022, 15 pgs.

* cited by examiner

BALE CARRYING DEVICE

CROSS-REFERENCE TO RELATED APPLICATIONS

This application claims the benefit of U.S. Provisional Application 62/892,928, filed on Aug. 28, 2019, which is hereby incorporated in its entirety by reference.

TECHNICAL FIELD

This disclosure relates to a carrying device. More specifically, this disclosure relates to a carrying device for carrying bales of material.

BACKGROUND

Loose materials are frequently bound together with bindings, such as twine, cords, straps, or wire, to form bales. Examples of such materials include hay and straw, including pine straw and wheat straw. In some instances, a bale of a particular material can be a standard unit of specific dimensions and shape, and often materials are sold, stored, and transported as bales. For example, hay is often sold in large round bales, which can weigh hundreds of pounds, or in smaller rectangular bales, which typically weigh less than 100 pounds. Whereas round bales are normally moved by machinery, such as a tractor, rectangular bales are often transported and stacked by hand. When moving rectangular bales, workers often grasp the bindings that extend around the bale and use them as impromptu handles. However, due to the relatively high weight of the bales and the thin nature of common binding materials, the bindings often painfully dig into the worker's hand, even when gloves are worn. Consequently, workers often must take breaks due to hand pain when carrying bales long distances or when moving large quantities of bales. Alternative methods of transporting individual bales with the help of an aid, such as a wheelbarrow, tend to be slow, inefficient, and limited by terrain and clearance considerations for the aid.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is a bale carrying device comprising a main body defining a handle portion; and a binding catch extending from the main body, the binding catch configured to engage a binding of a bale.

Also disclosed is a method for using a bale carrying device, the method comprising grasping a handle portion of a main body of the bale carrying device; engaging a binding catch of the bale carrying device with a binding of a bale, the binding catch extending from the main body, the binding extending around the bale; and lifting the bale with the bale carrying device.

Also disclosed is a bale carrying device comprising a handle portion; a base portion, the handle portion attached to a top side of the base portion, the base portion defining a first side and a second side; and a binding catch attached to the first side, the binding catch extending upwards above the top side.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
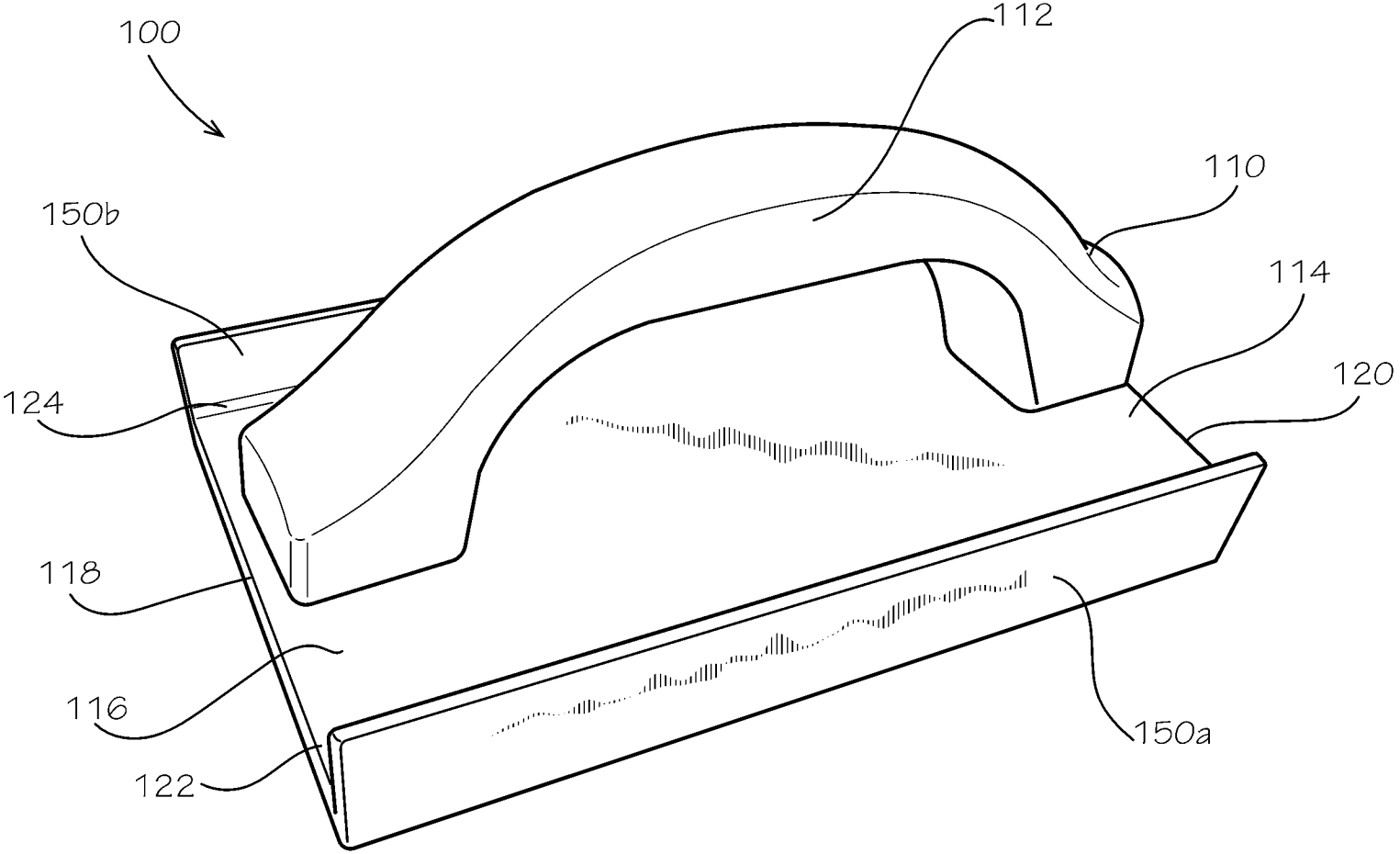
FIG. 1 is a perspective side view of a bale carrying device comprising a main body, a first binding catch, and a second binding catch in accordance with one aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed, that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a bale carrying device and associated methods, systems, devices, and various apparatus. The bale carrying device can comprise a main body and a binding catch. It would be understood by one of skill in the art that the disclosed bale carrying device is described in but a few exemplary aspects among many. No particular terminology or description should be considered limiting on the disclosure or the scope of any claims issuing therefrom.

FIG. 1 is a perspective side view of a bale carrying device 100 comprising a main body 110 and at least one binding catch 150. In the present aspect, the bale carrying device 100 can comprise a first binding catch 150*a* and a second binding catch 150*b* (referred to generally as "binding catches 150"). In other aspects, the bale carrying device 100 can comprise greater or fewer than two binding catches 150.

In the present aspect, the main body 110 can comprise a handle portion 112 and a base portion 114, and the handle portion 112 can be attached to or monolithically formed with a top side 116 of the base portion 114. The base portion 114 can define a bottom side (not shown) opposite from the top side 116. The main body 110 can define a first end 118 and a second end 120, with the first end 118 defined opposite from the second end 120. In the present aspect, the ends 118,120 can be defined by the base portion 114. The handle portion 112 can extend along the base portion 114 between the first end 118 and the second end 120. The main body 110 can also define a first side 122 and a second side 124, with the first side 122 defined opposite from the second side 124. In the present aspect, the sides 122,124 can be defined by the base portion 114. The first side 122 can be substantially parallel to the second side 124, and each of the sides 122,124 can be substantially perpendicular to each of the ends 118,120.

In the present aspect, the binding catches 150 can extend from and can be attached to the bottom side of the base portion 114, and the binding catches 150 can extend outwards from the adjacent sides 122,124 and upwards above the top side 116. For example, the first binding catch 150*a* can extend outwards from the first side 122, and the second binding catch 150*b* can extend outwards from the second side 124. In this aspect, the binding catches 150 can each be defined by a piece of angle stock, for example and without limitation, having a 90-degree profile. In other aspects, the binding catches 150 can be defined by a different type of material having a different shape, such as a curved shape for example and without limitations. In other aspects, the binding catches 150 can be directly attached to or monolithically formed with the respective sides 122,124.

Figure 2:
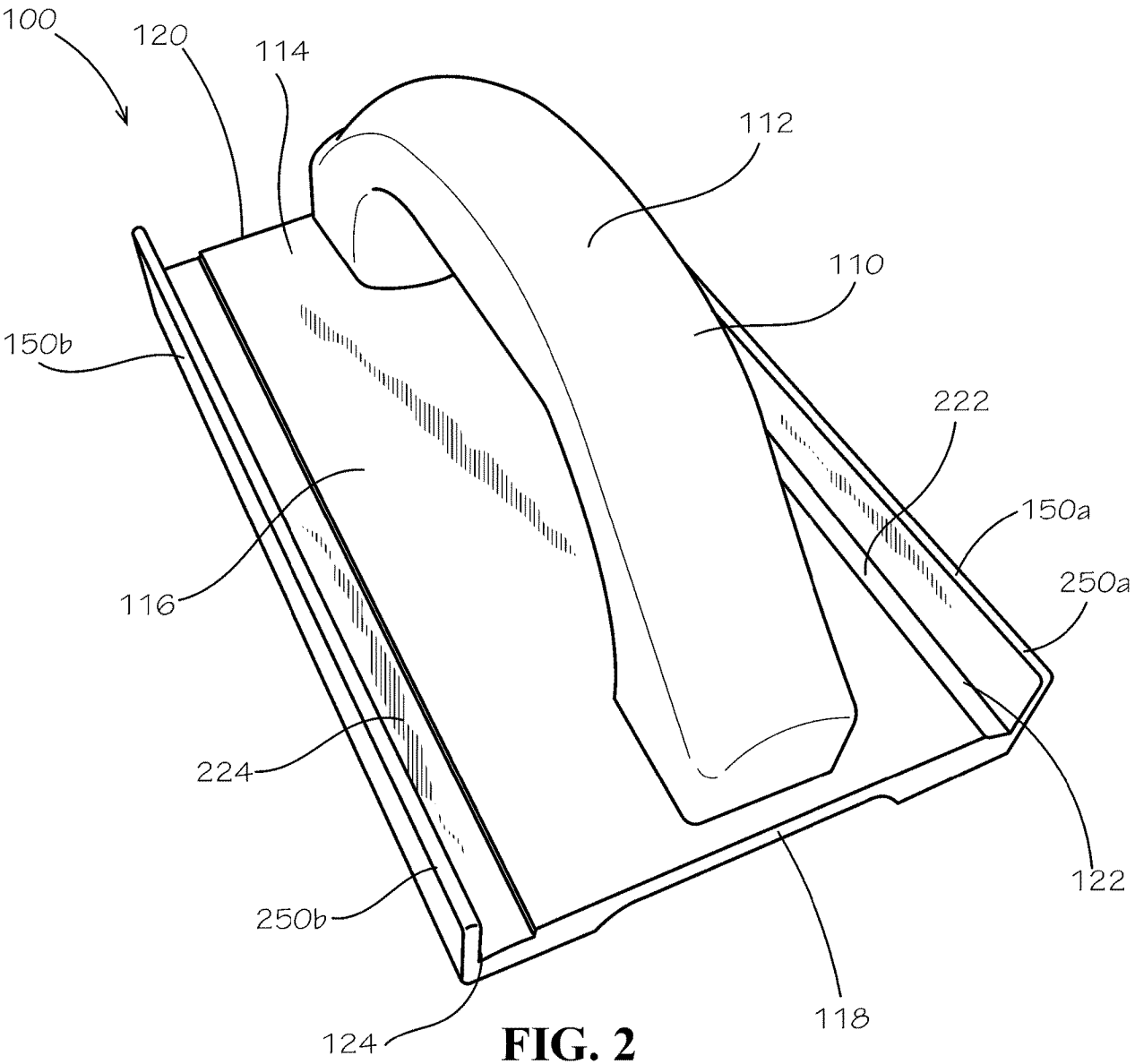
FIG. 2 is a perspective front view of the bale carrying device of FIG. 1.

FIG. 2 is a perspective front view of the bale carrying device 100 of FIG. 1. In the present aspect, the binding catches 150*a,b* can define upper catch portions 250*a,b*, respectively, and the upper catch portions 250*a,b* can extend upwards from the top side 116 of the base portion 114. In the current aspect, the upper catch portions 250*a,b* are walls extending upwards from the top side 116 of the base portion 114. As shown and discussed in further detail below, the bale carrying device 100 can be configured to receive bindings 502*a,b* (shown in FIG. 5) of a bale 500 (shown in FIG. 5) to facilitate the transportation and handing of the bale 500 by the bindings 502*a,b*. A first binding 502*a* can be positioned over the top side 116 between the handle portion 112 and the upper catch portion 250*a* while a second binding 502*b* can be positioned over the top side 116 and between the handle portion 112 and the upper catch portion 250*b*. The upper catch portions 250*a,b* can prevent the bindings 502*a,b* from slipping off of the top side 116 while carrying the bale 500.

In the present aspect, the top side 116 can define a pair of chamfered edges 222,224 at the sides 122,124, which can be configured to guide the bindings 502*a,b* towards the respective upper catch portions 250*a,b* and can form grooves adjacent to the upper catch portions 250*a,b*. In the present aspect, the upper catch portions 250*a,b* can be positioned in facing contact with the respective sides 122,124, and the chamfered edges 222,224 can guide the bindings 502*a,b* to rest against the upper catch portions 250*a,b*, respectively. The bindings 502*a,b* can then be held in place in the grooves against the upper catch portions 250*a,b*. In other aspects, the upper catch portions 250*a,b* can be spaced apart from the respective sides 122,124 to define channels (not shown) between the upper catch portions 250*a,b* and the adjacent sides 122,124. In such aspects, the pair of chamfered edges 222,224 can guide the bindings 502*a,b* into the channels.

In the present aspect, the binding catches 150*a,b* can extend in a front-to-back direction relative to the first end 118 and the second end 120 of the main body 110. This configuration can be desirable for carrying bales 500 in which the bindings 502*a,b* extend lengthwise around the bale 500. In other aspects, the binding catches 150*a,b* can extend side-to-side relative to the sides 122,124. Such a configuration can be desirable for carrying bales 500 in which the bindings 502*a,b* extend around a shorter width of the bale 500, instead of the longer length direction. In some aspects, the bale carrying device 100 can comprise binding catches 150 extending both front-to-back and side-to-side. In some aspects, binding catches 150 can be attached to and can extend from the ends 118,120.

Figure 3:
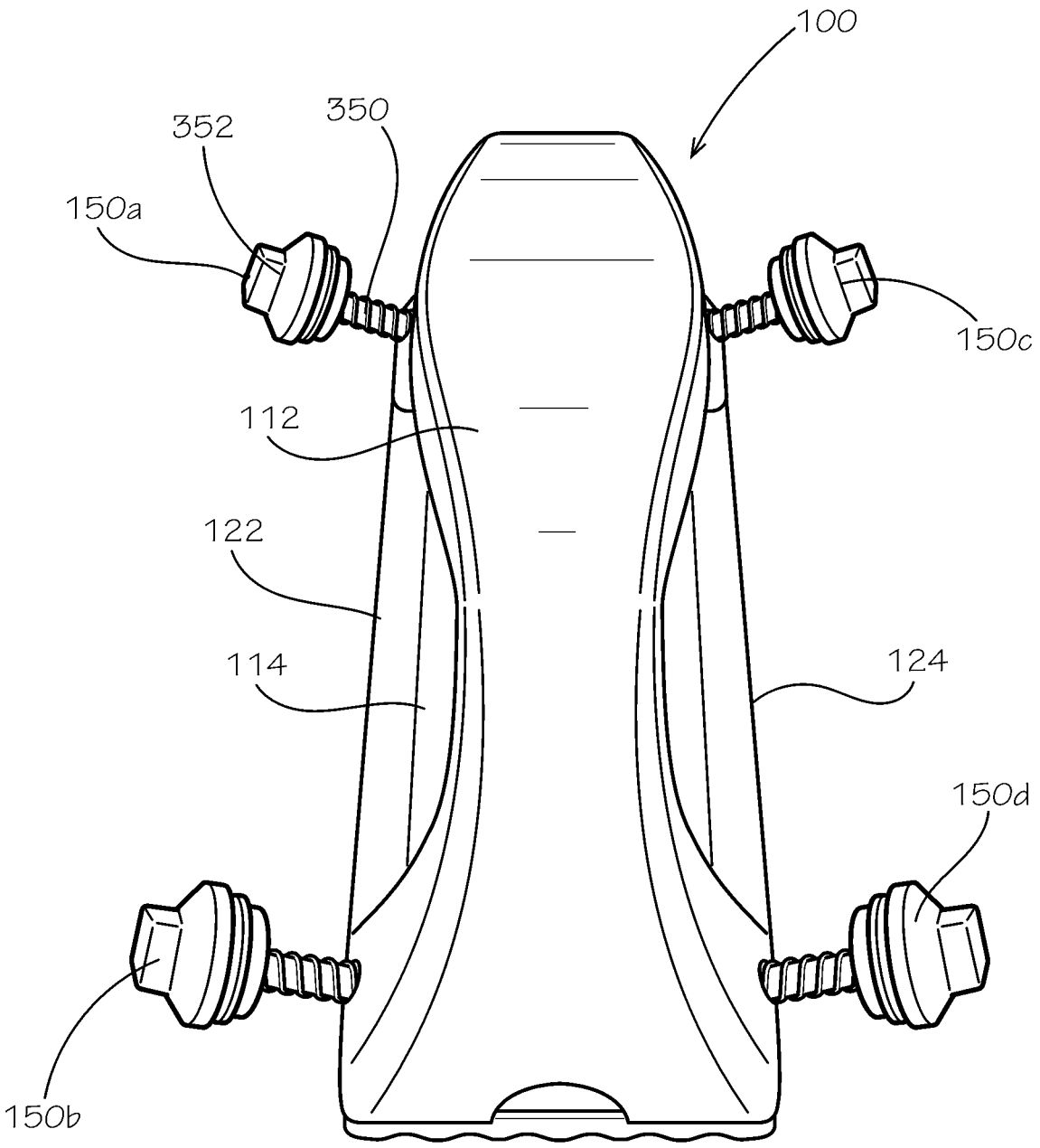
FIG. 3 is a front view of another aspect of the bale carrying device in accordance with another aspect of the present disclosure.

FIG. 3 is a front view of another aspect of the bale carrying device 100 in accordance with another aspect for the present disclosure. In the aspect shown, the binding catches 150 can be attached to and can extend from the handle portion 112 of the main body 110, rather than the base portion 114. In the present aspect, the bale carrying device 100 can comprise four binding catches 150*a,b,c,d*. In other aspects, the bale carrying device 100 can have greater or fewer than four binding catches 150. In the present aspect, the binding catches 150*a,b,c,d* can be distributed two per side 122,124; however, in other aspects, the bale carrying device 100 can have different distributions of binding catches 150 about the main body 110.

As demonstrated by binding catch 150*a*, each binding catch 150 can define a protruding portion 350 extending outward from the handle portion 112 and an end portion 352 attached to the protruding portion 350 opposite form the handle portion 112. For example and without limitation, the protruding portion 350 can be a shaft, and the end portion 352 can be an enlarged head. In some aspects, the binding catches 150 can be defined by fasteners, such as screws, rivets, or bolts for example and without limitation. The first binding 502*a* (shown in FIG. 5) can be placed over the protruding portions 350 of binding catches 150*a,b*, and the second binding 502*b* (shown in FIG. 5) can be placed over the protruding portions 350 of binding catches 150*c,d* to engage the bale carrying device 100 with the bale 500 (shown in FIG. 5). The end portions 352 can prevent the bindings 502*a,b* from sliding off of the respective protruding portions 350 of the binding catches 150.

In some aspects, the binding catches 150 may not comprise the end portions 352. In some aspects, for example and without limitation, the protruding portions 350 can be angled upwards from the handle portion 112, as shown in FIG. 3, so that gravity biases the bindings 502*a,b* towards the handle portion 112. In some aspects, the protruding portions 350 can be upturned, such as in the shape of a hook for example and without limitation.

Figure 4:
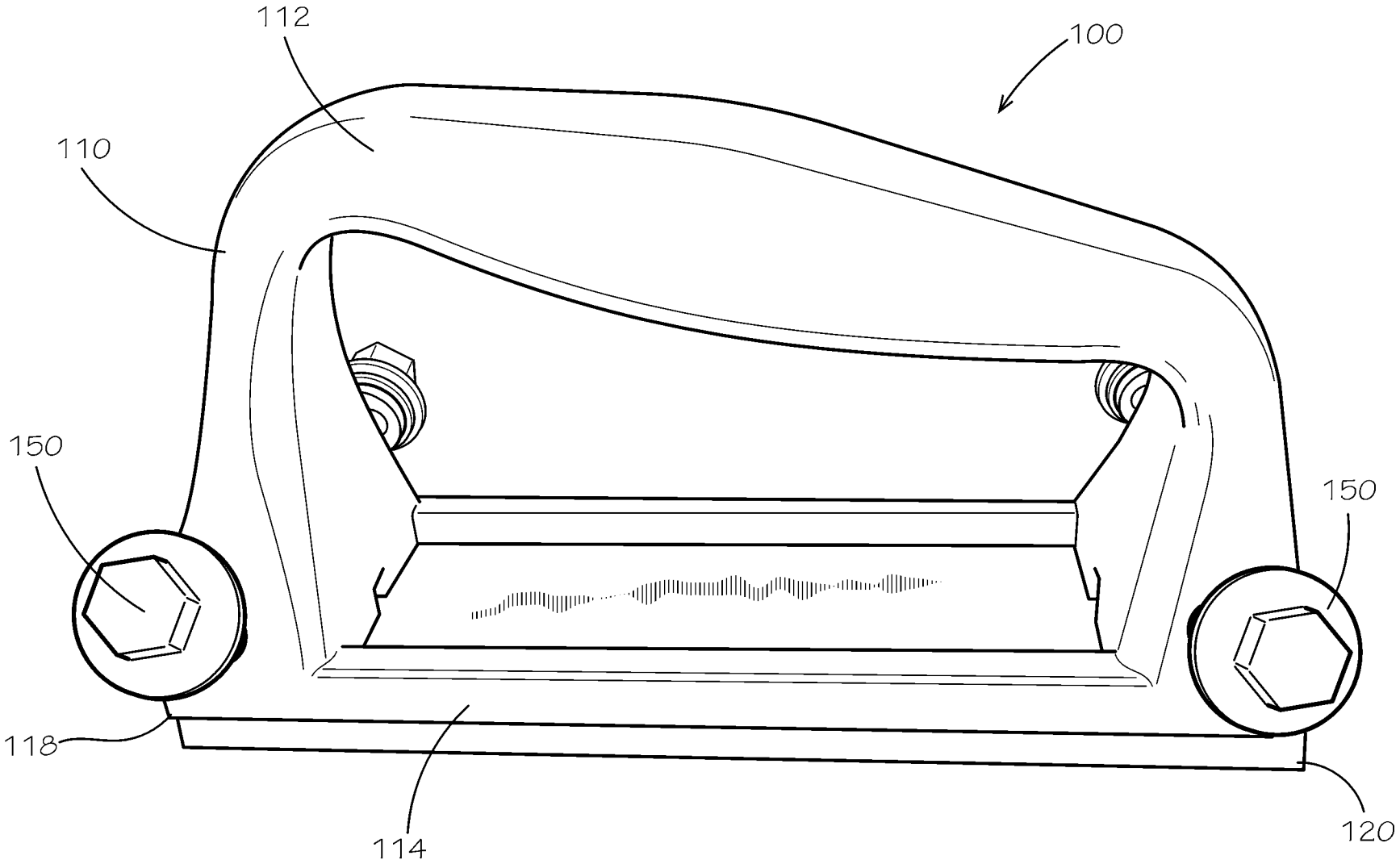
FIG. 4 is a side view of the bale carrying device of FIG. 3.

FIG. 4 is a side view of the bale carrying device 100 of FIG. 3. As shown, the binding catches 150 can attach to the handle portion 112 rather than the base portion 114 of the main body 110. In some aspects, the main body 110 of the bale carrying device 100 may not have a base portion 114. In such aspects, the binding catches 150 can be attached directly to the handle portion 112 or monolithically formed with the handle portion 112, for example and without limitation.

In some aspects, the handle portion 112 can slope downwards from the first end 118 to the second end 120. In some aspects, an angle of the slope of the handle portion 112 can be configured to exert less stress on a user's hands and wrists when carrying bales 500 (shown in FIG. 5) with the bale carrying device 100. In other aspects, the handle portion 112 may not be sloped.

Figure 5:
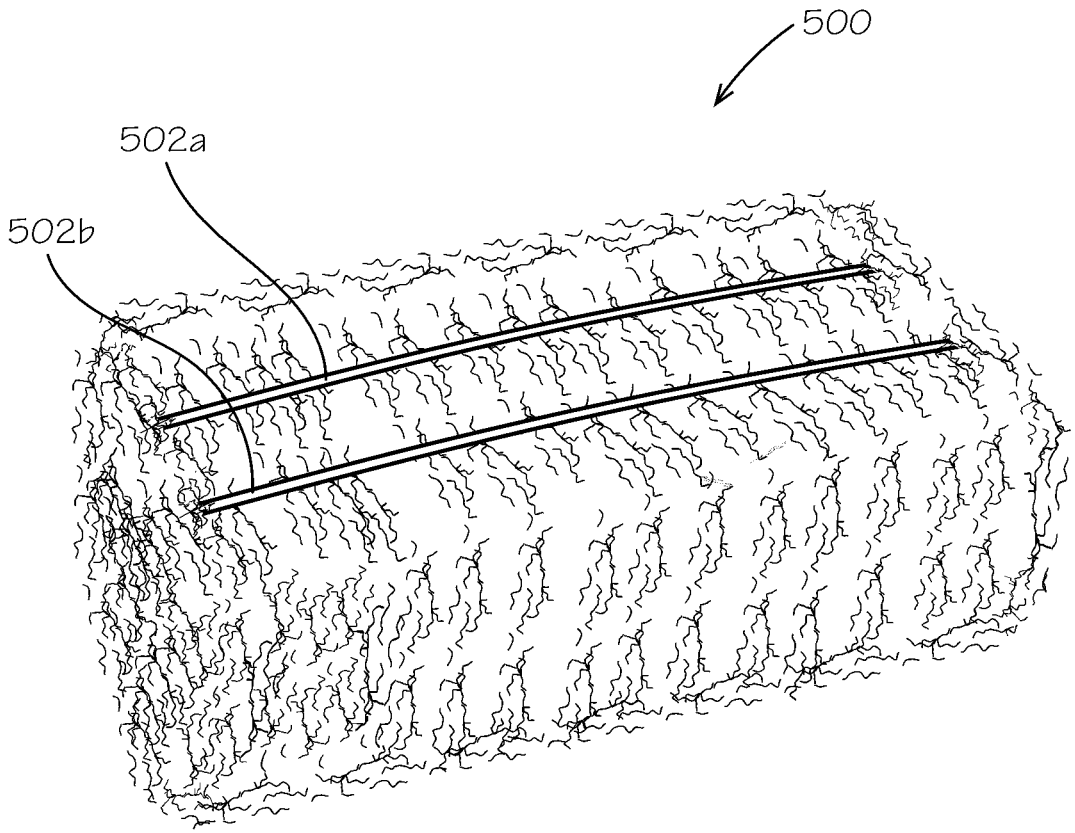
PRIOR ART FIG. 5
FIG. 5 is a perspective view of a bale comprising a first binding and a second binding.

FIG. 5 is a perspective view of a typical rectangular bale 500, such as one comprising hay, straw, pinestraw, or any other material. In the present aspect, the bale 500 can be bound by a pair of bindings 502*a,b*, which can extend lengthwise around a longest dimension of the bale 500, rather than widthwise and substantially perpendicular to the longest dimension. Widthwise bindings are common with some bales, such as cotton bales, whereas lengthwise bindings are common with hay and straw bales, such as wheat straw or pine straw. In the present aspect, the bindings 502*a,b* can comprise twine; however, in other aspects, the bindings 502*a,b* can comprise other materials such as wire, cord, string, rope, straps, belts, or any other suitable material, any of which can be compatible with the bale carrying device 100.

Figure 6:
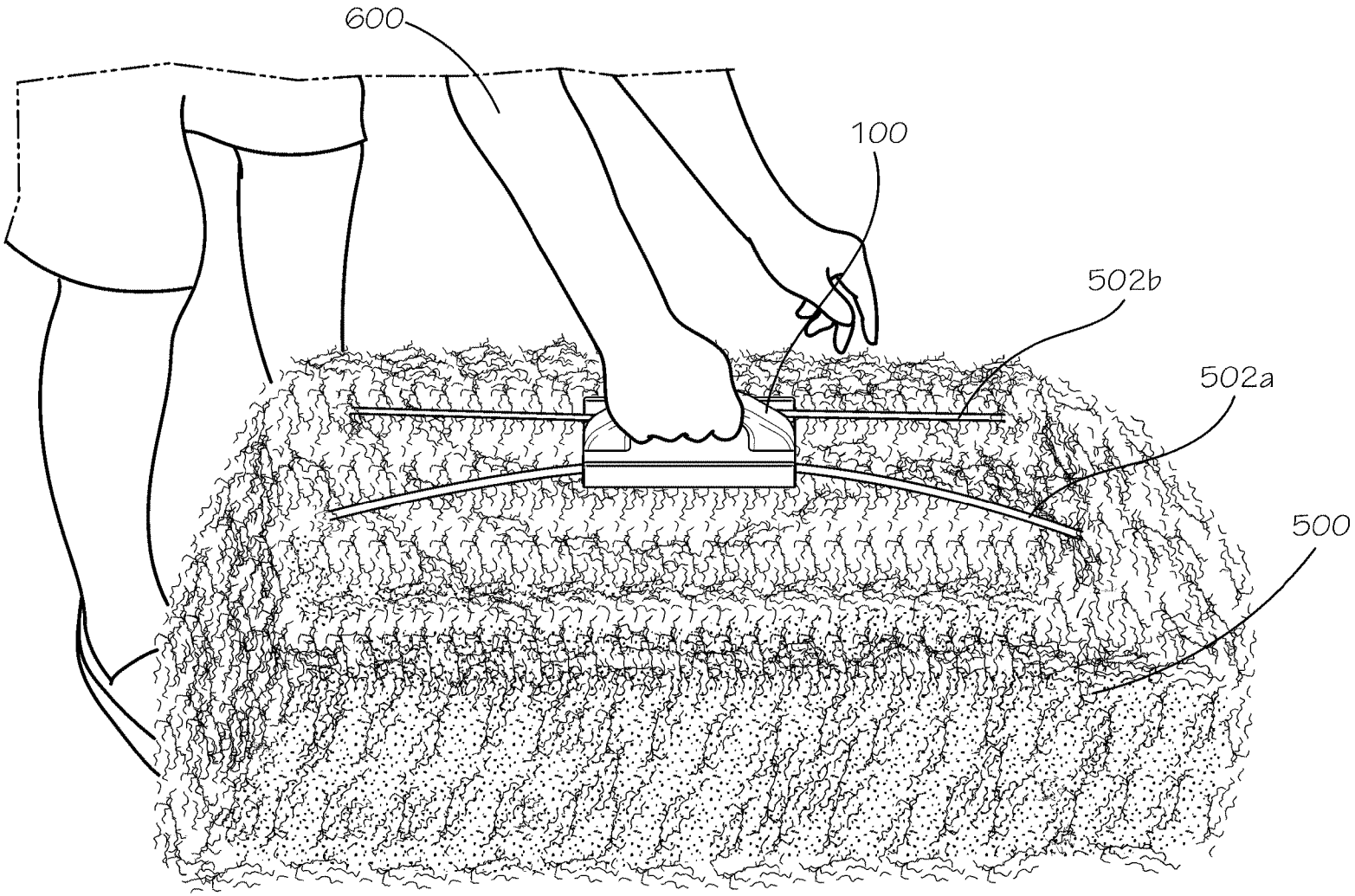
FIG. 6 is a perspective view of a user grasping the bale carrying device of FIG. 1 with the bale carrying device engaging the first binding and the second binding of the bale of FIG. 5.

FIG. 6 is a perspective view of a user 600 grasping the bale carrying device 100 of FIG. 1 and the bale carrying device 100 engaging the first binding 502*a* and the second binding 502*b* of the bale 500 of FIG. 5. The bindings 502*a,b* can be engaged with the respective binding catches 150 (shown in FIG. 1) by lifting the bindings 502*a,b* over the binding catches 150 or by slipping the binding catches 150 under the bindings 502*a,b*. In some aspects, the bindings 502*a,b* are thereby held in the channels or grooves. As shown, when the bale carrying device 100 engages the bindings 502*a,b*, the bindings 502*a,b* can pinch inwards towards the bale carrying device 100. In some aspects, the bale carrying device 100 can engage both bindings 502*a,b* with one binding catch 150.

Figure 7:
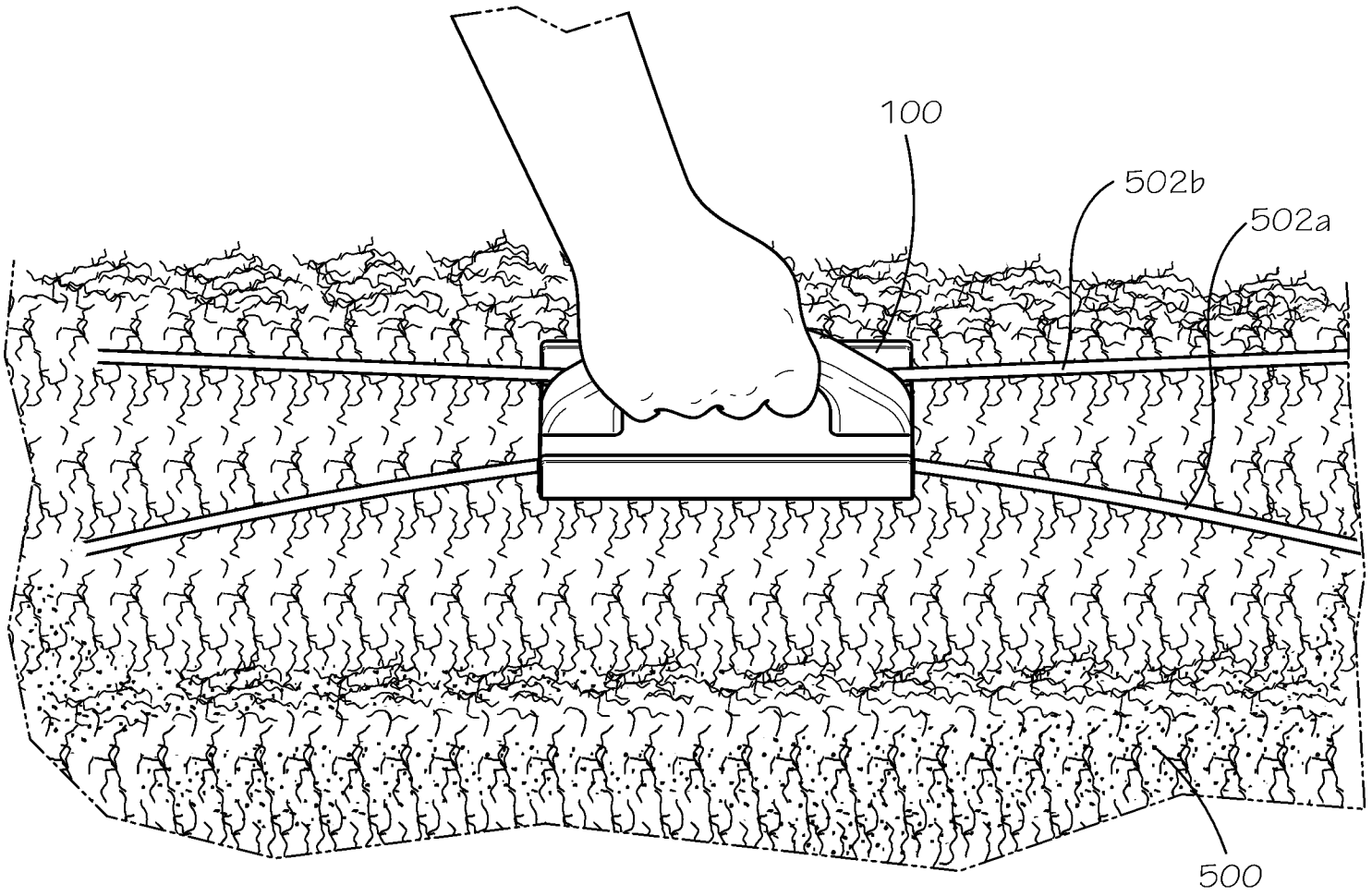
FIG. 7 is a close-up perspective view of the bale carrying device of FIG. 1 engaging the first binding and the second binding of the bale of FIG. 5.

FIG. 7 is a close-up perspective view of the bale carrying device 100 of FIG. 1 engaging the first binding 502*a* and the second binding 502*b* of the bale 500 of FIG. 5.

Figure 8:
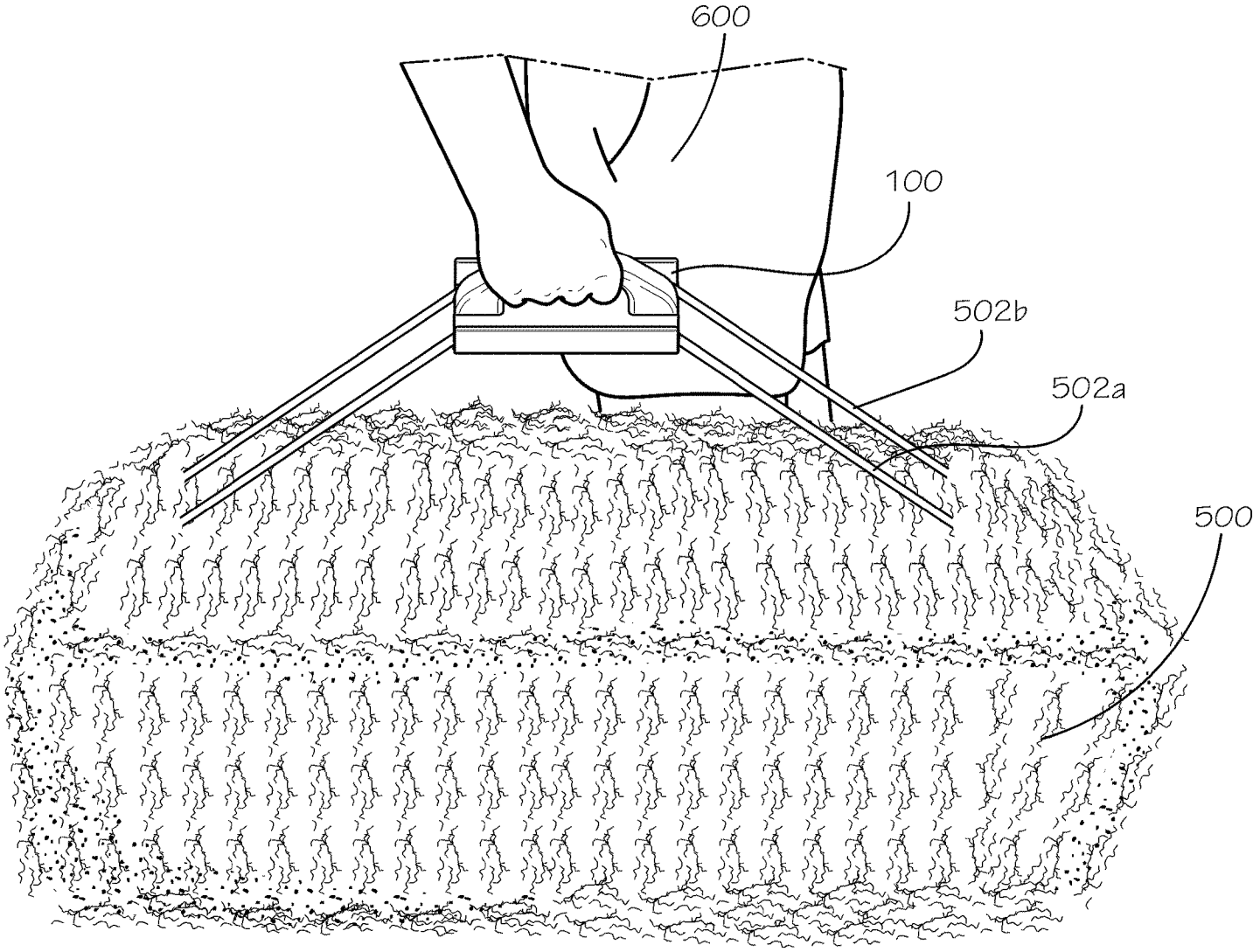
FIG. 8 is a side view of the user lifting the bale of FIG. 5 with the bale carrying device of FIG. 1.

FIG. 8 is a side view of the user 600 lifting the bale 500 of FIG. 5 with the bale carrying device 100 of FIG. 1. When the user 600 lifts the bale 500 by the bindings 502*a,b*, the bindings 502*a,b* can pull away from the bale 500. This slack in the bindings 502*a,b* facilitates engagement and disengagement of the bale carrying device 100 with the bindings 502*a,b*.

Figure 9:
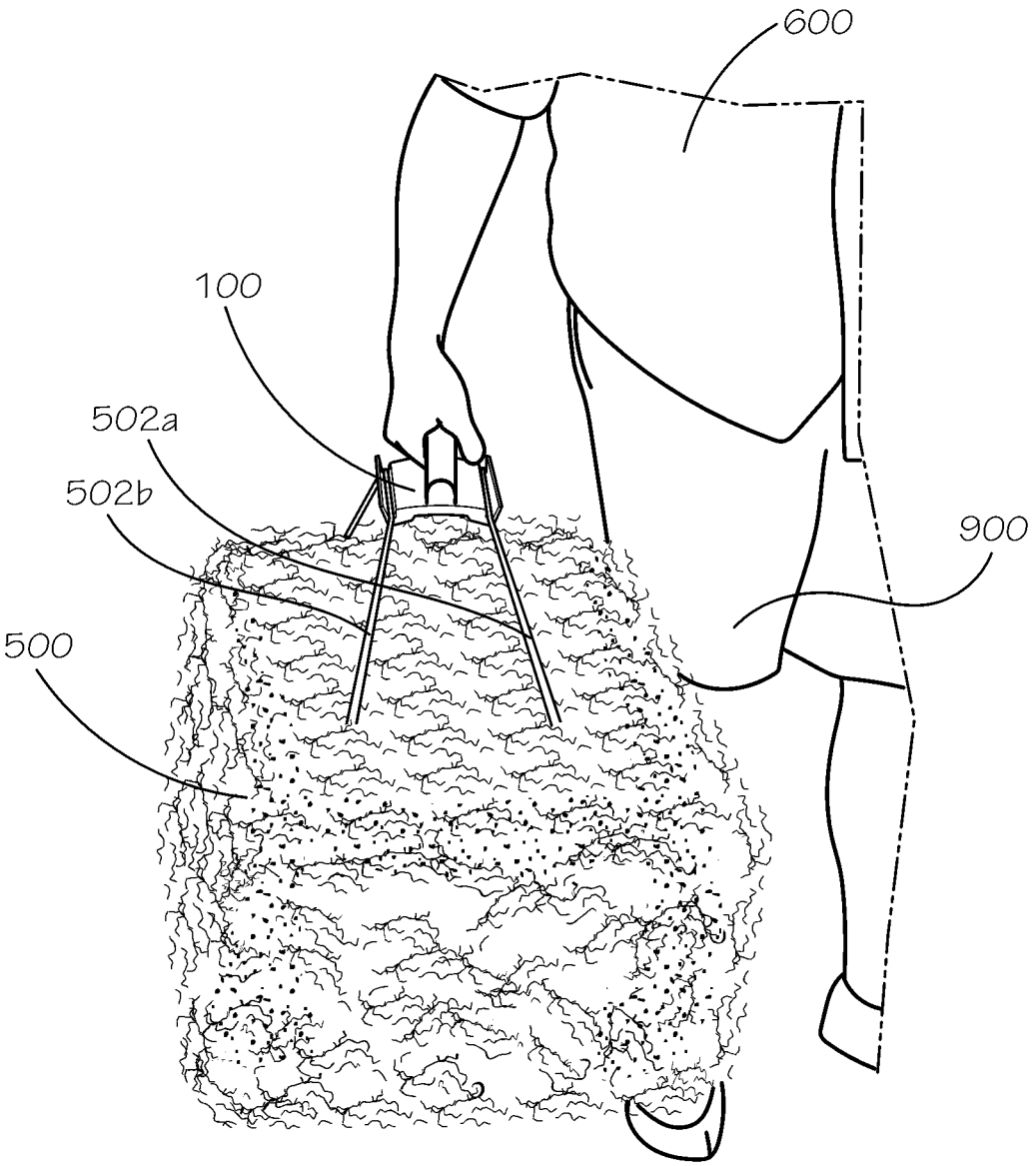
FIG. 9 is a front view of the user lifting the bale of FIG. 5 with the bale carrying device of FIG. 1.

FIG. 9 is a front view of the user 600 lifting the bale 500 of FIG. 5 with the bale carrying device 100 of FIG. 1. By engaging the bindings 502*a,b* in a way that orients the longest dimension of the bale 500 substantially parallel to a direction of travel of the user 600 (such as walking in a forward direction), interference between the bale 500 and a near-side leg 900 of the user 600 can be minimized.

Figure 10:
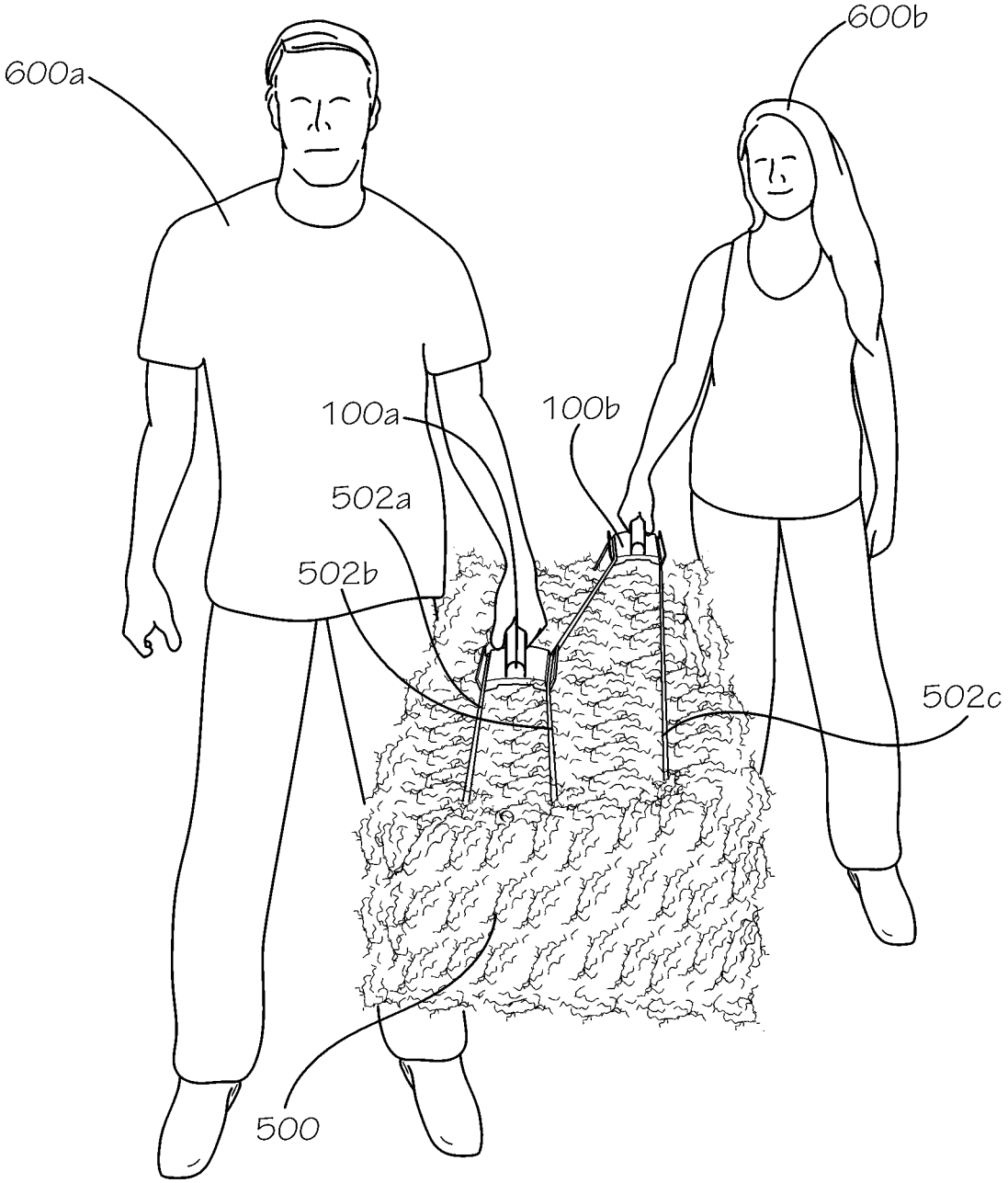
FIG. 10 is a front view of a pair of users lifting a bale with a pair of the bale carrying devices of FIG. 1, according to another aspect of the present disclosure.

FIG. 10 is a front view of a pair of users 600*a,b* lifting another aspect of a bale 500. In the current aspect, the bale 500 of FIG. 10 is larger than the bale 500 of FIG. 5 and comprises three bindings 502*a,b,c*. The bale 500 can be lifted with a pair of bale carrying devices 100*a,b*. The user 600*a* can engage the bale carrying device 100*a* with bindings 502*a,b* and the user 600*b* can engage the bale carrying device 100*b* with bindings 502*b,c*. The users 600*a,b* can also carry the bale 500 from opposite sides of the bale 500, as shown. In other aspects with more than three bindings 502, the bale carrying devices 100*a,b* can engage any two to four bindings 502 and may or may not share one or two bindings 502, similar to the bale carrying devices 100*a,b* sharing the binding 502*b* as shown in FIG. 10.

Figure 11:
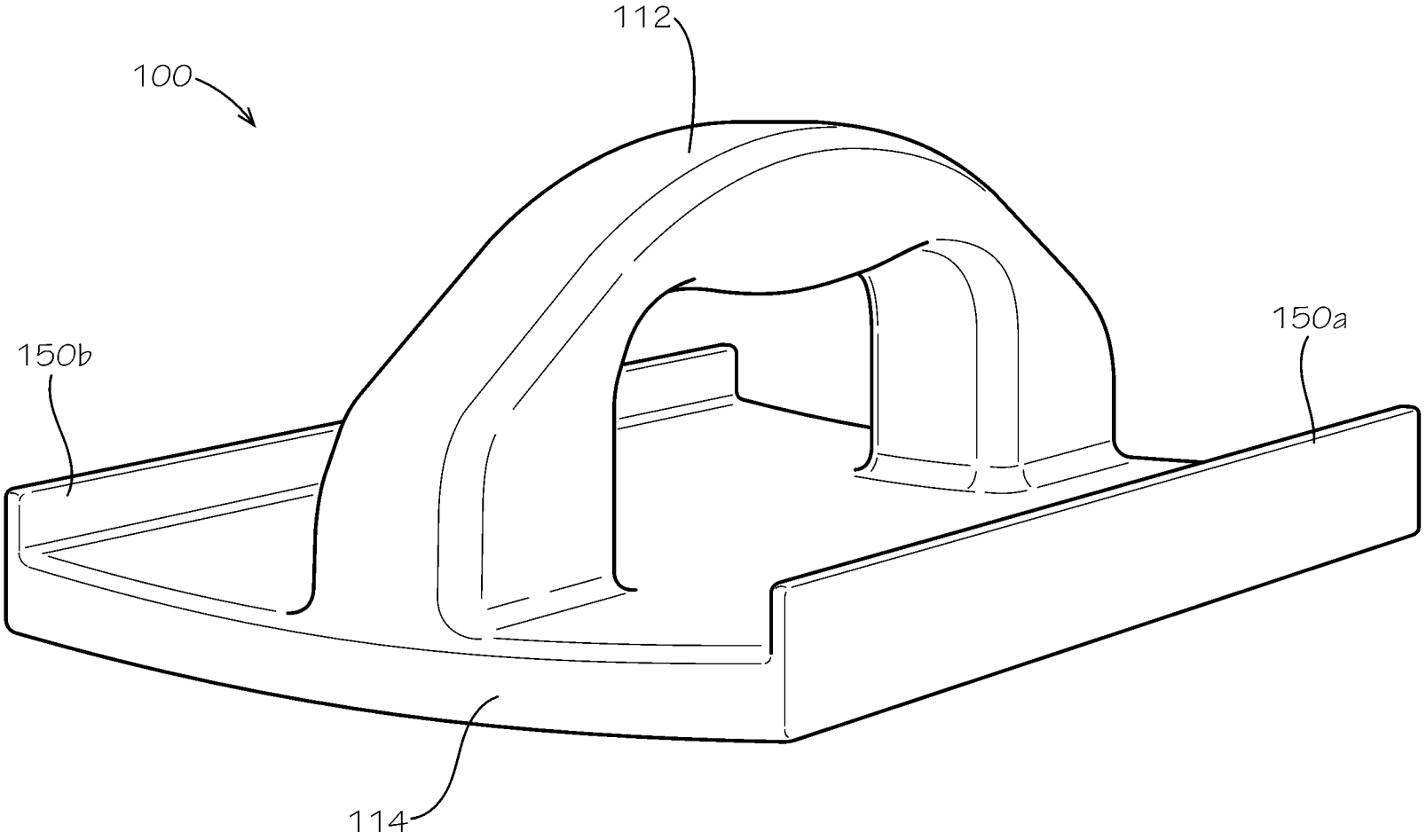
FIG. 11 is a perspective view of another aspect of the bale carrying device in accordance with another aspect of the present disclosure.

FIG. 11 is a perspective view of another aspect of the bale carrying device 100 in accordance with another aspect of the present disclosure. In the present aspect, the binding catches 150*a,b*, the base portion 114, and the handle portion 112 can be integrally formed as a single body.

Figure 12:
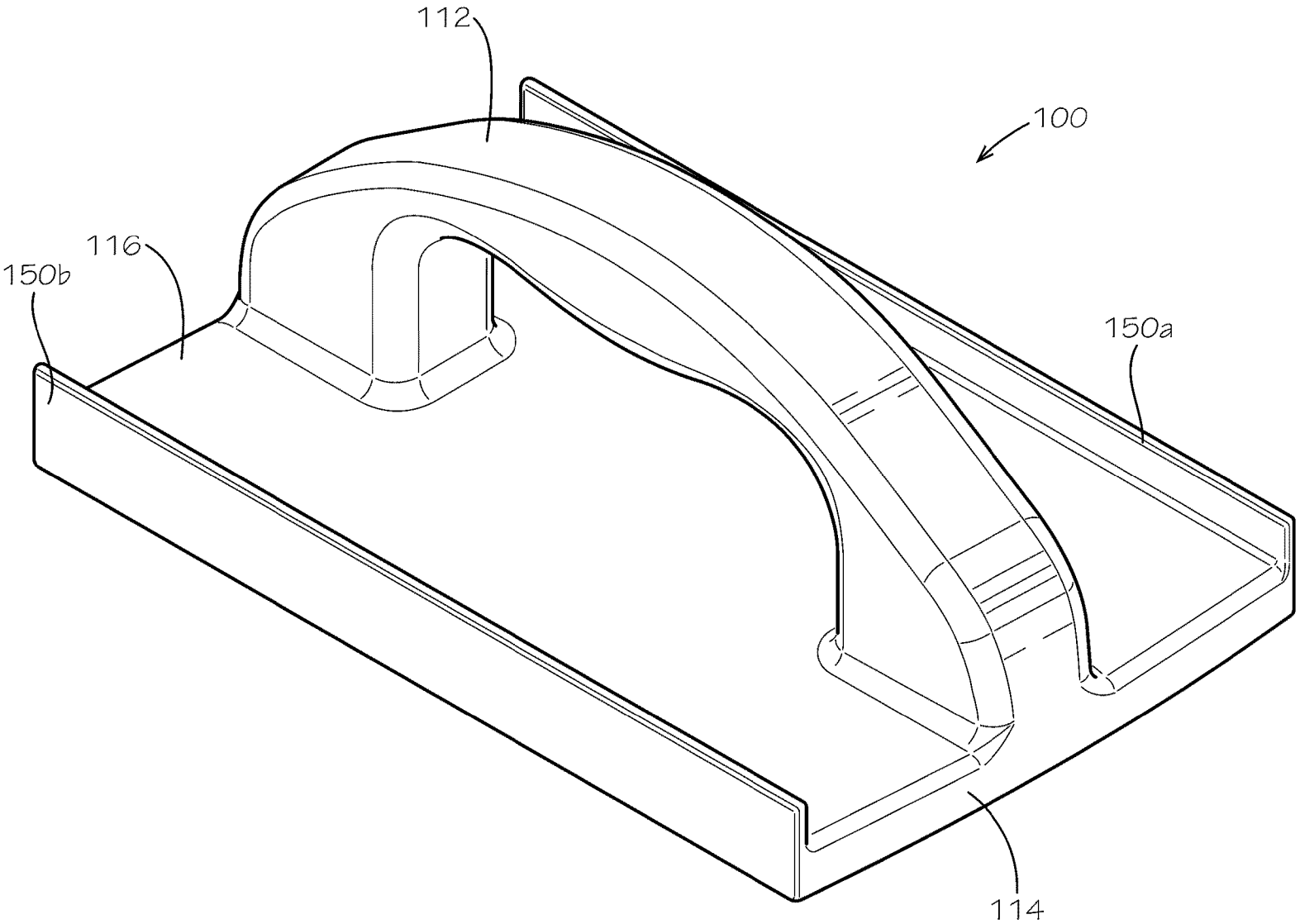
FIG. 12 is a perspective view of the bale carrying device of FIG. 11.

FIG. 12 is a perspective view of the bale carrying device 100 of FIG. 11. Because the binding catches 150*a,b* are integrally formed with the base portion 114 in the present aspect, no separate grooves are defined between the binding catches 150*a,b*. Instead, the space between the bindings catches 150*a,b* and the handle portion 112 can act as the grooves by receiving bindings 502*a,b* (shown in FIG. 5). In some aspects, grooves can be integrally formed into the top side 116 of the base portion 114, such as adjacent to the respective binding catches 150*a,b*.

Figure 13:
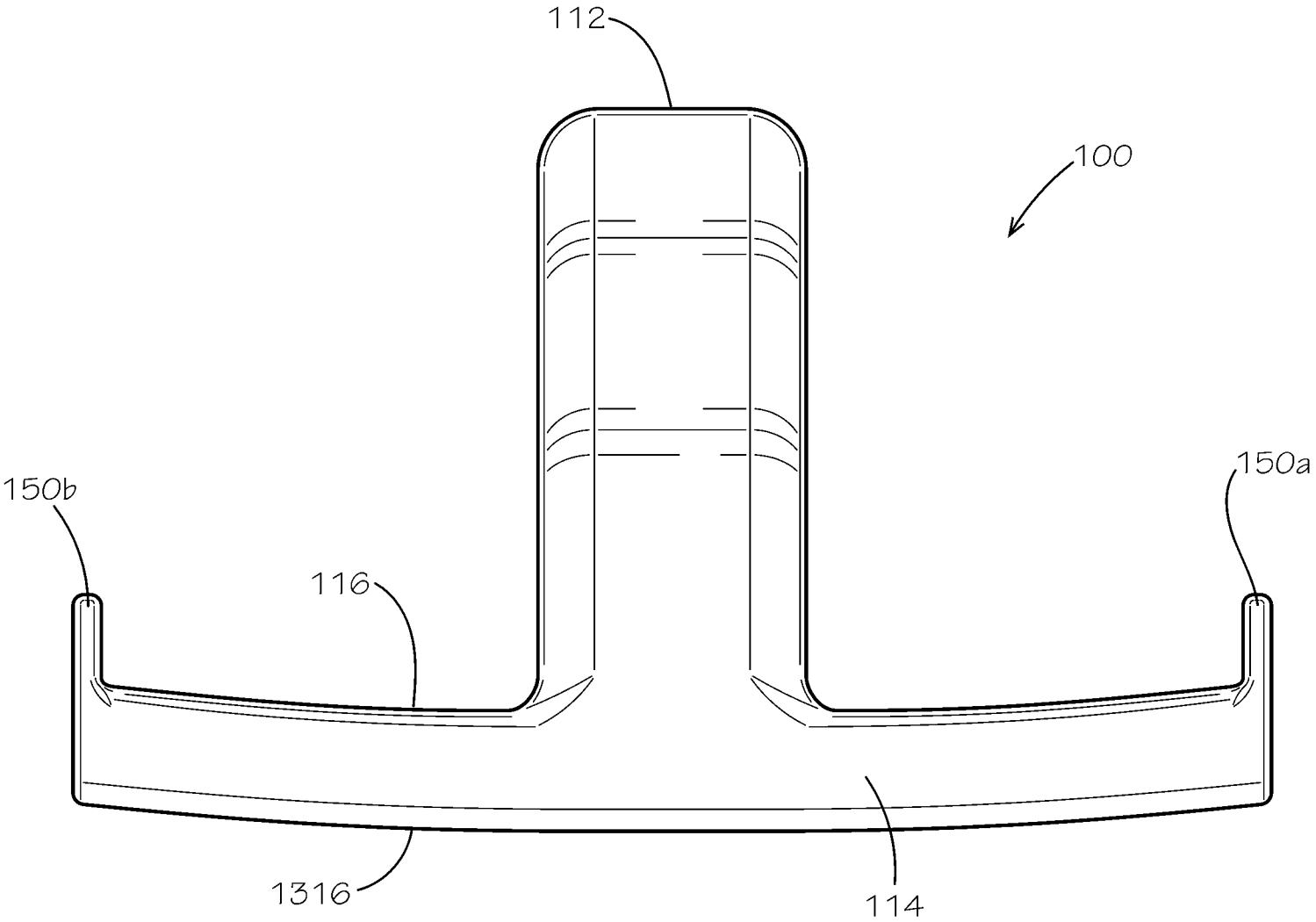
FIG. 13 is an end view of the bale carrying device of FIG. 11.

FIG. 13 is an end view of the bale carrying device 100 of FIG. 11. As shown, the base portion 114 can be curved such that the top side 116 of the base portion defines a concave surface and a bottom side 1316 of the base portion 114 defines a concave surface. Accordingly, the base portion 114 can arch slightly upwards as it extends outwards from the handle portion 112 and towards the adjacent binding catches 150*a,b*.

Figure 14:
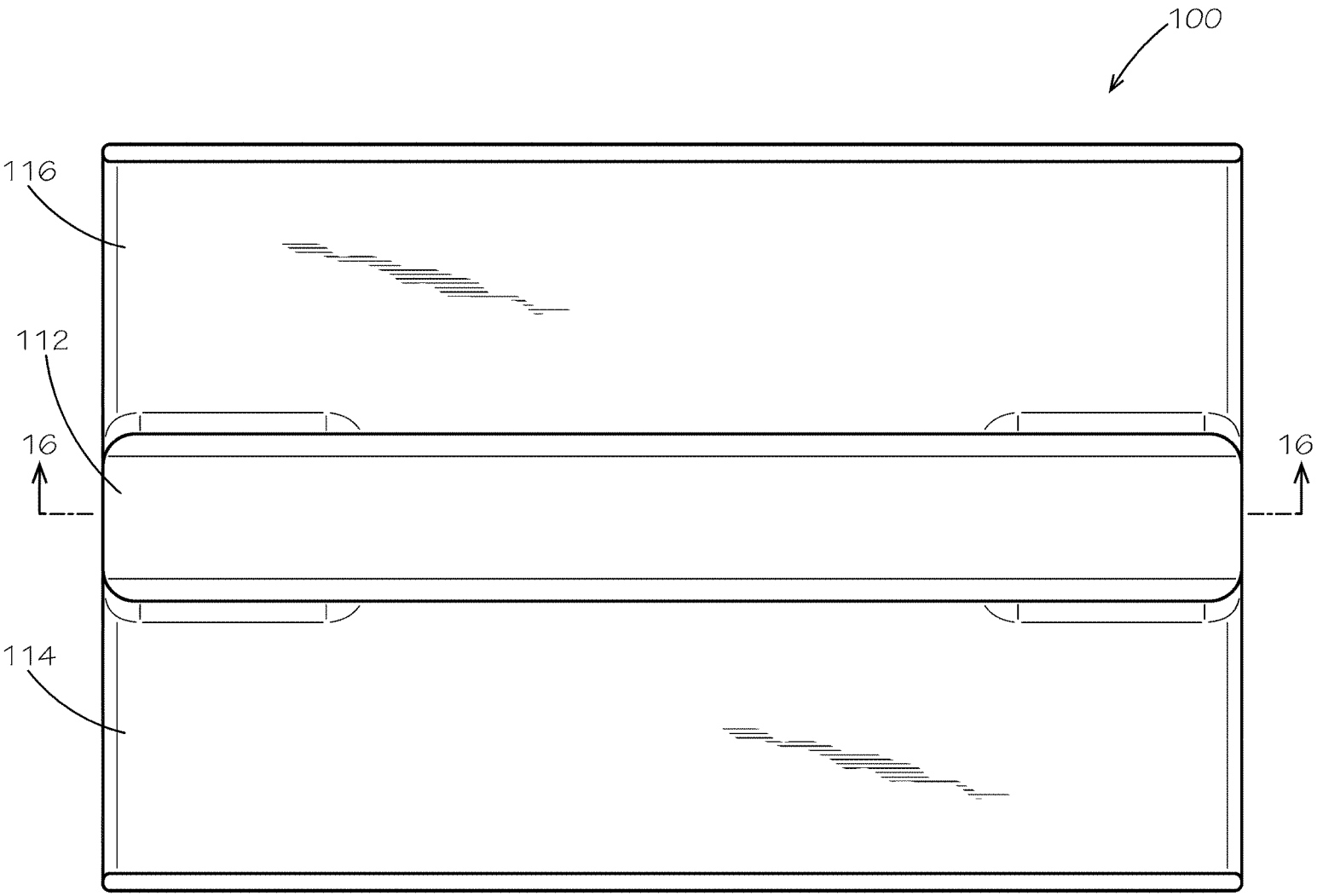
FIG. 14 is a top view of the bale carrying device of FIG. 11 showing the handle portion and the top side of the base portion.

FIG. 14 is a top view of the bale carrying device 100 of FIG. 11 showing the handle portion 112 and the top side 116 of the base portion 114.

Figure 15:
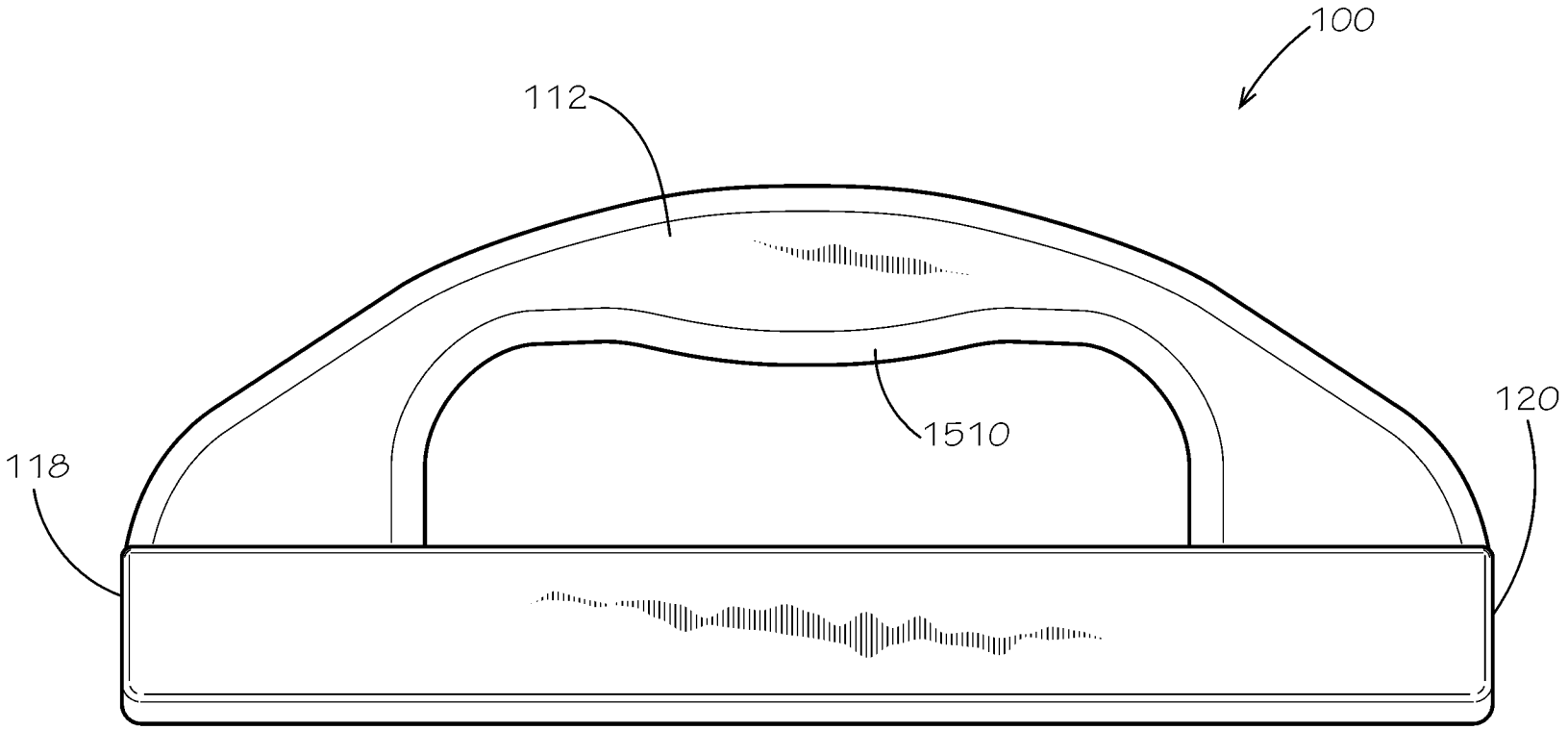
FIG. 15 is a side view of the bale carrying device of FIG. 11.

FIG. 15 is a side view of the bale carrying device 100 of FIG. 11. In contrast to the aspect of FIGS. 3 and 4, here the handle portion 112 does not slope upwards or downwards from the first end 118 to the second end 120. Additionally, the handle portion 112 can define a palm swell 1510 to provide additional comfort for a user's hand. The palm swell 1510 can also prevent the handle portion 112 from slipping forwards or rearwards in the user's hand while being carried.

Figure 16:
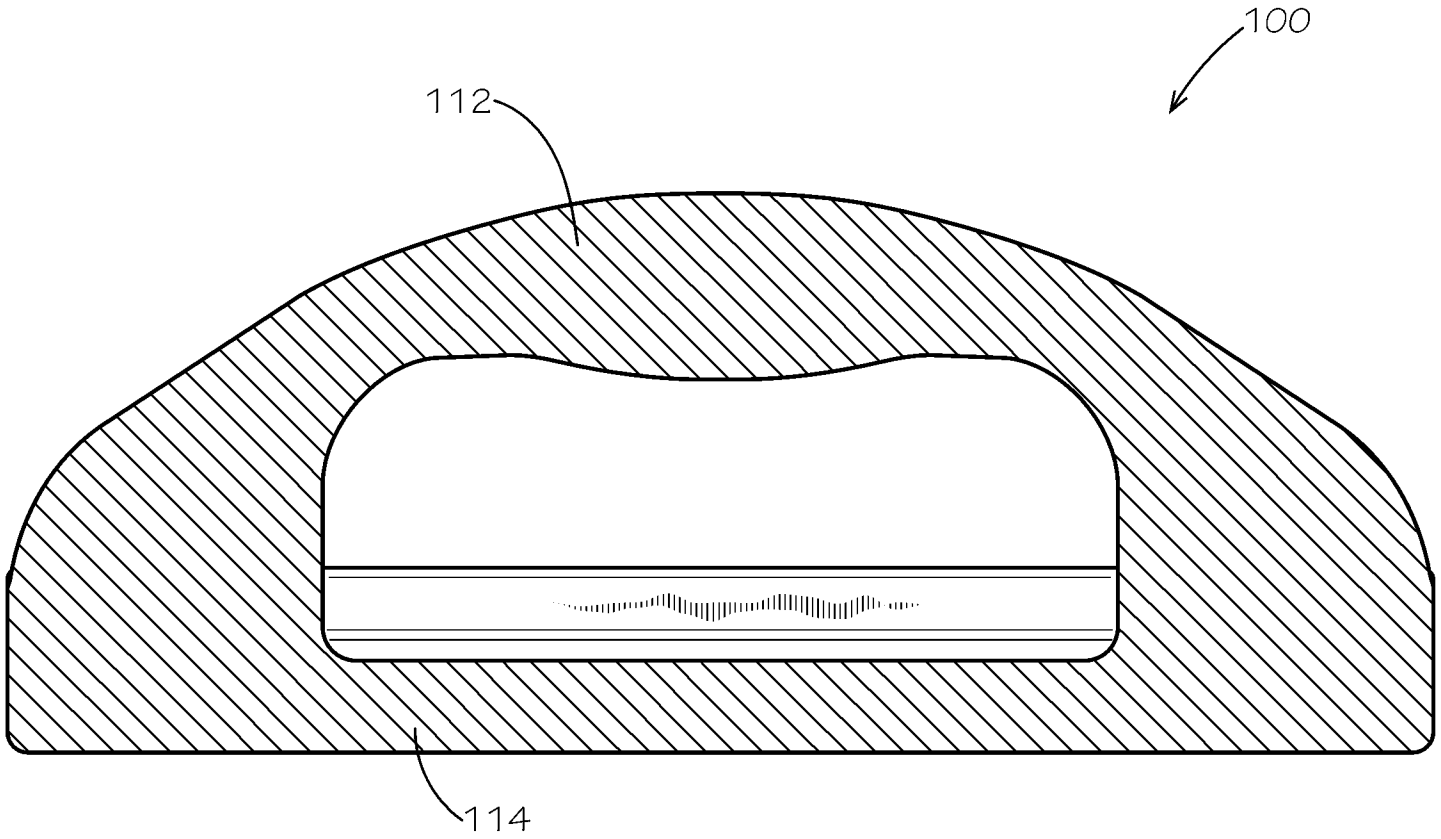
FIG. 16 is a cross-sectional view of the bale carrying device of FIG. 11 taken along line 16-16 shown in FIG. 14.

FIG. 16 is a cross-sectional view of the bale carrying device 100 of FIG. 11 taken along line 16-16 shown in FIG. 14. The cross-sectional view demonstrates the monolithic construction of the base portion 114 and the handle portion 112.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A bale carrying device comprising:

a main body defining a handle portion and a base portion, the handle portion extending from a top side of the base portion, the handle portion and the top side together defining a hand opening, the hand opening configured to receive a portion of a user's hand, the main body defining a first end and a second end positioned opposite from the first end, the base portion defining a first side and a second side positioned opposite from the first side, the base portion extending laterally outward from the handle portion to the first side and from the handle portion to the second side, the handle portion extending from the first end to the second end, the handle portion defining a length and a width, the length measured in a first direction extending between the first end and the second end, the width measured in a second direction extending between the first side and the second side, the width being narrower than the length, a width of the base portion being greater than the width of the handle portion, the width of the base portion measured from the first side to the second side;

a first binding catch extending from the first side of the base portion of the main body at least partially between the first end and the second end, an upper catch portion of the first binding catch extending upwards from the top side of the base portion, the first binding catch configured to engage a binding of a bale; and a second binding catch extending from the second side of the base portion of the main body, an upper catch portion of the second binding catch extending upwards from the top side of the base portion.

2. The bale carrying device of claim 1, wherein the first binding catch extends continuously from the first end to the second end.

3. A method for using a bale carrying device, the method comprising:

grasping a handle portion of a main body of the bale carrying device, the main body further defining a base portion, the handle portion extending from a top side of the base portion, the handle portion and the top side together defining a hand opening, the hand opening configured to receive a portion of a user's hand, the main body defining a first end and a second end positioned opposite from the first end, the base portion defining a first side and a second side positioned opposite from the first side, the base portion extending laterally outward from the handle portion to the first side and from the handle portion to the second side, the handle portion defining a length and a width, the length measured in a first direction extending between the first end and the second end, the width measured in a second direction extending between the first side and the second side, the width being narrower than the length, the handle portion extending from the first end to the second end, a width of the base portion being greater than the width of the handle portion, the width of the base portion measured from the first side to the second side;

engaging a first binding catch of the bale carrying device with a first binding of a bale comprising positioning the first binding on the top side of the base portion between the first binding catch and the handle portion, the first binding catch extending from the first side of the main body, an upper catch portion of the first binding catch extending upwards from the top side of the base portion, the first binding catch positioned at least partially between the first end and the second end, the first binding extending around the bale;

engaging a second binding catch of the bale carrying device with a second binding of the bale comprising positioning the second binding on the top side of the base portion between the second binding catch and the handle portion, the second binding catch extending from the second side of the main body, an upper catch portion of the second binding catch extending upwards from the top side of the base portion, the second binding catch positioned at least partially between the first end and the second end, the second binding extending around the bale; and lifting the bale with the bale carrying device.

4. The method of claim 3, wherein the method further comprises positioning the handle portion between the first binding and the second binding.

5. The method of claim 3, wherein grasping the handle portion of the main body of the bale carrying device comprises:

positioning an index finger of a hand of a user on the handle portion between the first end and the second end; and positioning a pinky finger of the hand of the user on the handle portion between the index finger and the second end.

6. The method of claim 3, wherein the first binding extends over a portion of the bale carrying device from the first end to the second end.

7. The method of claim 3, wherein the first binding catch extends continuously from the first end to the second end.

* * * * *